US005301695A

United States Patent [19]

Wong

[11] Patent Number: 5,301,695

[45] Date of Patent: Apr. 12, 1994

[54] BRUSH AND METHOD FOR HAIR TREATMENT USING BRISTLE ARRAYS OF DIFFERENT DENSITIES AND MATERIALS

[76] Inventor: Hilda c. Wong, 14701 Saltamontes Way, Los Altos Hills, Calif. 94022

[21] Appl. No.: 963,061

[22] Filed: Oct. 19, 1992

[51] Int. Cl.[5] ..... A45D 24/16

[52] U.S. Cl. ..... 132/108; 132/142

[58] Field of Search ..... 132/120, 126, 108, 142, 132/219, 137

[56] References Cited

U.S. PATENT DOCUMENTS

| | | | |
|---|---|---|---|
| D. 101,982 | 11/1936 | Dean . | |
| D. 182,949 | 6/1958 | Chiariello | D86/8 |
| D. 188,479 | 7/1960 | Chiariello | D86/8 |
| D. 194,731 | 2/1963 | Dent | D86/10 |
| D. 194,732 | 2/1963 | Dent | D86/10 |
| D. 196,560 | 10/1963 | Dent | D9/2 |
| D. 196,707 | 10/1963 | Anderson | D9/2 |
| D. 218,958 | 10/1970 | Thompkins | D4/7 |
| D. 226,462 | 3/1973 | Gibbs | D4/7 |
| 819,444 | 5/1906 | Monroe | 132/120 |
| 961,127 | 6/1910 | Helm | 132/120 |
| 1,833,293 | 11/1931 | Laguionie | 132/142 |
| 2,123,043 | 7/1938 | Hertzberg | 132/120 |
| 2,238,603 | 5/1941 | Runnels | 132/85 |
| 2,383,967 | 9/1945 | Hernon | 132/120 |
| 2,655,925 | 10/1953 | Ulvad | 132/137 |
| 2,672,875 | 3/1954 | Kovacs | 132/13 |
| 2,865,383 | 12/1958 | Kaley | 132/120 |
| 3,047,898 | 8/1962 | Levite | 15/159 |
| 3,059,652 | 10/1962 | Thomas | 132/120 |
| 3,133,546 | 5/1964 | Dent | 132/120 |
| 3,180,342 | 4/1965 | Dietsche | 132/120 |
| 3,690,331 | 9/1972 | Messer | 132/120 |
| 4,592,376 | 6/1986 | Sigmund et al. | 132/112 |
| 4,691,720 | 9/1987 | Schmitz | 132/112 |
| 5,002,075 | 3/1991 | Kellett et al. | 132/108 |
| 5,062,435 | 11/1991 | Ohtsuka | 132/120 |
| 5,077,914 | 1/1992 | Yamamoto | 34/95 |

FOREIGN PATENT DOCUMENTS

| | | | |
|---|---|---|---|
| 506904 | 11/1954 | Canada . | |
| 996183 | 12/1951 | France | 132/142 |
| 13528 | of 1898 | United Kingdom | 132/120 |

*Primary Examiner*—Gene Mancene
*Assistant Examiner*—Todd E. Manahan
*Attorney, Agent, or Firm*—Schneck & McHugh

[57] ABSTRACT

A device for applying a hair treatment solution, such as dye, includes a body having a head and a handle extending from the head. Three arrays of bristles extend from a major surface of the head in a direction perpendicular to the direction of the handle. A center array of bristles has a high bristle density and functions as an absorbent structure for retaining and applying a treatment solution. The end arrays sandwich the center array and have a low bristle density. The bristles of the end arrays have a greater rigidity than those of the center array. The device is used to simultaneously comb hair on one side of a hair partition, apply treatment solution to the partition, spread the treatment solution, and repartition the hair for a subsequent application of treatment solution.

19 Claims, 2 Drawing Sheets

BRUSH AND METHOD FOR HAIR TREATMENT USING BRISTLE ARRAYS OF DIFFERENT DENSITIES AND MATERIALS

TECHNICAL FIELD

The present invention relates generally to hair treatment and more particularly to devices and methods for applying a dye solution and the like.

BACKGROUND ART

A commonly used process for dying hair is to use a comb to separate strands of hair and then to use a container having a dispensing end to dispense a dye solution to exposed hair roots. A small brush having one row of hard bristles or a finger may be used to spread the dye solution over the exposed hair roots.

After dye has been applied in one location, the person's hair is again partitioned and a second application is provided at the new partition. This process is repeated until the entire hair root system of the person has been treated. The hair must be repeatedly partitioned and combed and dye solution must be spread over each new partition. Great care is taken not to miss any root areas.

There are a number of disadvantages to use of this method, whether practiced at a person's home or at a beauty salon. At a beauty salon, the process is time consuming and therefore expensive. Moreover, the brush that is commonly used to spread dye solution includes a handle and the single row of hard bristles. To ensure that the dye solution reaches each hair at the root area without increasing the time spent, a professional beautician may strike the bristles onto the hair roots. This striking causes discomfort. Another difficulty is that the brush will project dye solution beyond the hairline. If the dye is not removed entirely, an unsightly stain mark that reaches onto the face of the person will be left.

For home applications, the process is not only time consuming, but also tiring, since self-application requires a person to reach up to head level for an extended time. Additionally, the aid of a second person is necessary to ensure that no area at the back of the head of the person being treated is missed. Again, it is difficult to avoid projecting dye onto the face beyond the hairline.

It is an object of the present invention to provide a device and method for the application of a dye or other hair treatment solution, wherein the required time is shortened, the application is comfortable, excess dye is avoided, and a reliable self-treatment process is possible.

SUMMARY OF THE INVENTION

The above object has been met by a device which can be used to simultaneously comb, apply and spread a hair treatment solution, and repartition a person's hair. The four tasks are performed by three parallel arrays of bristles. A center array has a high bristle density. When the center array is dipped into a reservoir of solution, the close grouping of bristles provides a surface adhesion that retains a sufficient volume of solution for the desired hair treatment. The solution-filled bristles are brought to an area along which hair has been parted, allowing the solution to reach the roots of the hair.

The bristles of the center array are of equal length to create a flat surface at the bristle tips. The preferred bristle material for the center array is nylon, providing a structure that possesses the positive characteristics of a sponge in performing the tasks of applying and spreading the solution. However, the nylon bristles have a longer useful life than a sponge, since nylon is less likely to disintegrate with use. Moreover, a sponge would likely absorb an excess amount of solution, resulting in waste and in leaving some of the excess solution in the person's hair that may drip over one's face.

The two arrays that sandwich the center array have low bristle densities. In use, the array that leads the center array performs a combing function to aid in properly spreading the treatment solution. The following array repartitions the hair, to expose the hair roots at the next strand of hair, readying the exposed roots for a second application of the treatment solution.

The bristles of all three arrays are generally equal in length, so that all the bristles simultaneously contact a person's scalp in performing the four tasks of combing, applying, spreading and repartitioning. Void areas between the center array and the end arrays play a role in determining the distance between an original partition and a second partition.

All three arrays of bristles are located on the same side of a head of a brush body. In the preferred embodiment, the side on which the three arrays are located is curved. The brush body includes a handle. The bristles extend in a direction perpendicular to the length of the body.

In a preferred embodiment, the bristles of the two end arrays have only two rows, spaced about 0.25 inch apart. This is designed so that not too large a strand of hair is being partitioned at any one time. The bristles are disposed in a zig-zag pattern within the two rows. A wide spacing between adjacent bristles within the two end arrays reduces the possibility of hair being tangled. The material used to make these bristles should be plastic which does not absorb dye and is easy to clean.

The center array functions to pick up the treatment solution. The array is preferably larger than prior art dye-application brushes, permitting a larger area to be covered at each step of the process. The center array consists of bristles made of a material such as nylon which is not so rigid in texture that the bristles will cause striking pain when dye is being spread onto the hair roots.

Because of the larger area that each application can cover, the person can overlap areas in repeated applications to avoid missing any area, thus enabling the person to apply the color treatment without the help of a second person.

An advantage of the present invention is that the prior four-step process of first partitioning hair, applying hair dye, smoothing out the dye, and then repartitioning the hair for a second application of dye is reduced to a single step by having a leading widely spaced array of bristles to comb out hair, and by including a high density array of bristles for the application and spread of the dye and a low density array of bristles for pulling up a next strand of hair for a second application. The time saved in completing a dying or other hair treatment process is significant. While the device may be used by professional hair dressers, the present invention is particularly suited for achieving a reliable self-application treatment.

BEST MODE FOR CARRYING OUT THE INVENTION

Figure 1:
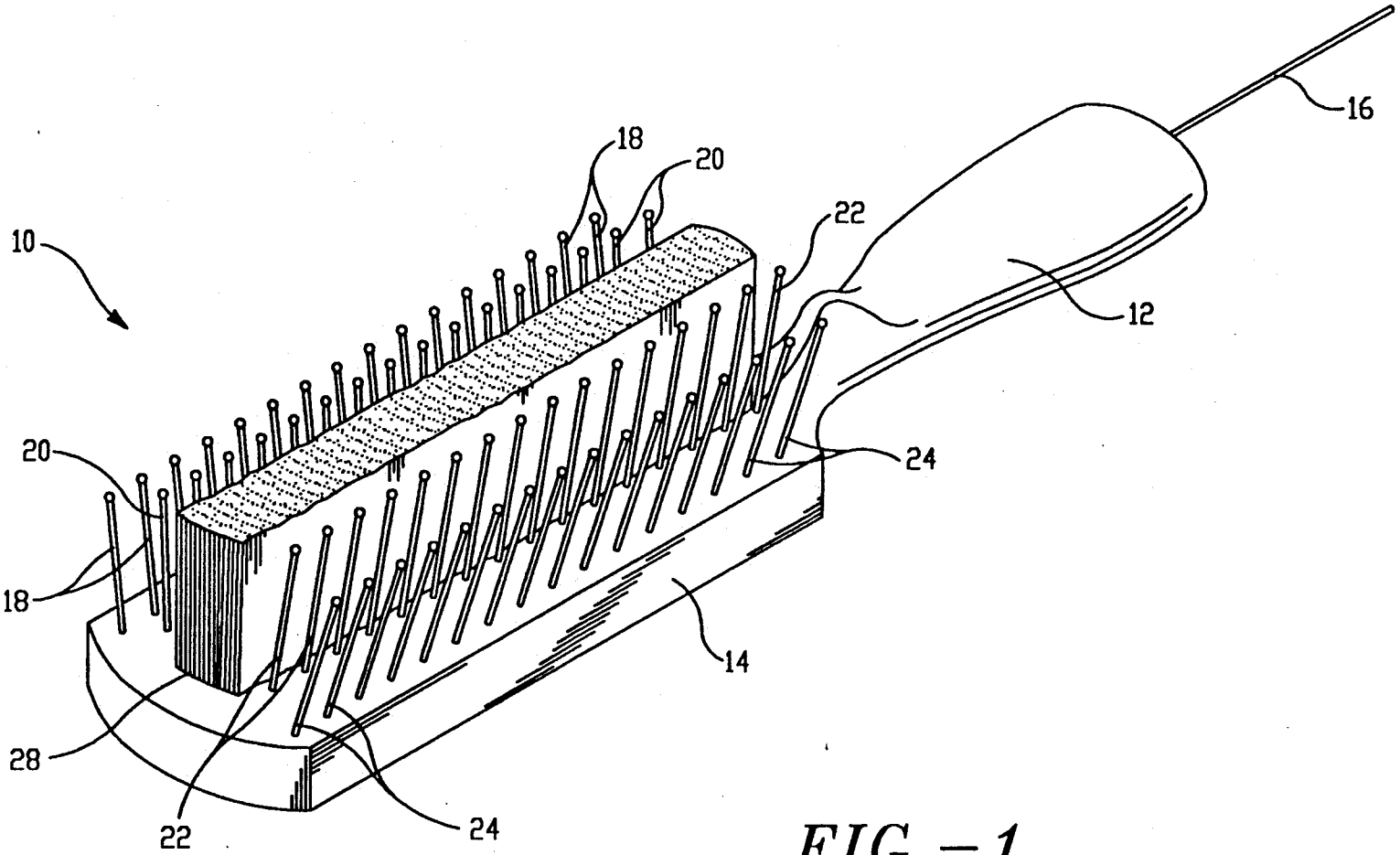
FIG. 1 is a perspective view of a brush device in accordance with the present invention.

With reference to FIG. 1, a hair treatment brush 10 includes a body having a handle 12 and a head 14. Typically, the handle and head are portions of a one-piece rigid member. A rat tail 16 optionally extends from the end of the handle that is opposite to the head. The rat tail may be used in forming a part, but is not critical.

Figure 2:
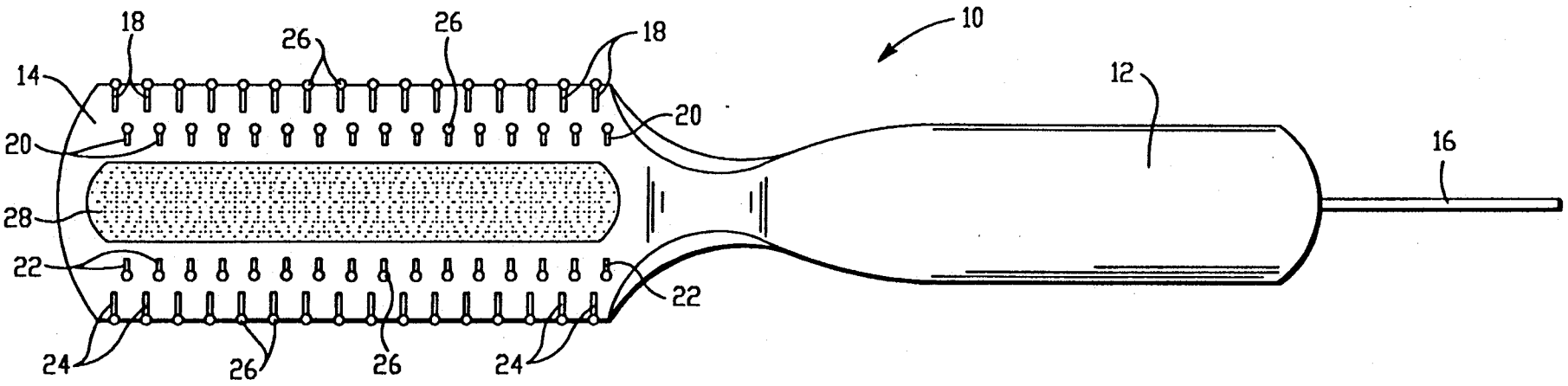
FIG. 2 is a bottom view of the device of FIG. 1.

Projecting from the head 14 of the brush 10 are three arrays of bristles. The first array of bristles 18 and 20 and the third array of bristles 22 and 24 each includes two rows. As best seen in FIG. 2, the bristles in these two rows form a zig-zag pattern. The tips of each of the first bristles 18 and 20 and the third bristles 22 and 24 have spherical members 26 formed by dipping the bristles into a molten plastic that hardens after it is allowed to set. Preferably, the first and third arrays of bristles 18–24 are made of a plastic having a rigidity sufficient to properly part a person's hair. These bristles 18–24 can also be comb-like teeth bristles.

The distance between adjacent first bristles 18 and 20 and the distance between adjacent third bristles 22 and 24 is within the range of 0.125 inch and 0.375 inch. Preferably, the spacing is 0.25 inch. The length of the first and third bristle arrays should exceed 2.5 inches, and is preferably 4.0 inches. The width of the head 14 is 2.0 inches, while the width of the handle 12 is 0.875 inch. The handle 12 has a length of 4.25 inches. None of these dimensions is critical.

The combination of the material makeup, the spherical tips 26, the pattern of the rows, and the spacing between adjacent bristles 18–24 forms an effective hair brushing arrangement at the first and third arrays of bristles. In use, one of the arrays will be a leading array that combs hair for proper distribution of treatment solution, while the other array is a following array that acts to repartition the hair for a subsequent application of treatment solution.

The hair treatment solution is applied using a tightly packed center array 28 of bristles. The bristle density of the center array is such that individual bristles are difficult to distinguish in FIGS. 1 and 2. The bristles within the center array preferably are made of nylon. The center array acts in the same manner as an absorbent structure, like a sponge, for a dripless retention of hair treatment solution after being dipped into such a solution. In comparison, the bristles 18–24 of the first and third arrays are non-absorbent, since the bristle material and distance between adjacent bristles are not conducive to retaining a solution.

Figure 4:
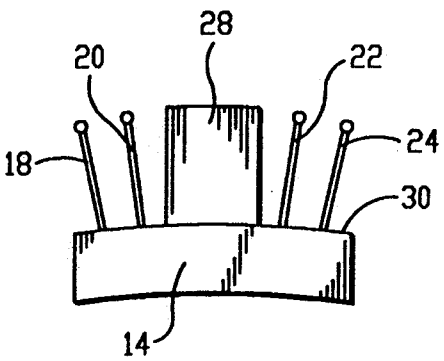
FIG. 4 is an end view of the device of FIG. 3.
Figure 3:
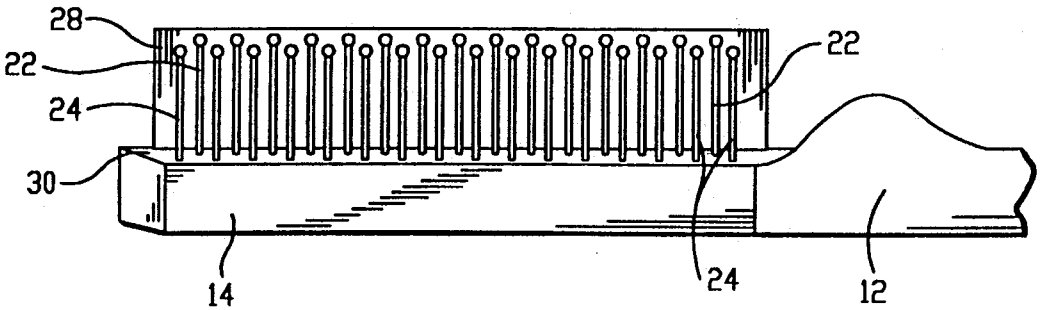
FIG. 3 is a partial, side view of the device of FIG. 2.

Referring now to FIGS. 3 and 4, the length of the center array 28 is approximately equal to that of the rows of first and third bristles 18–24. The width of the center array 28 is approximately 0.4375 inch. These dimensions, however, are not critical.

The lengths of the first and third bristles 18–24 and the bristles of the center array 28 are generally equal. For example, each bristle may be approximately 0.75 inch. While the surface 30 of the head 14 from which the bristles project is shown as being arcuate, the lengths of the bristles should be such that all of the bristles are simultaneously able to contact the scalp of a person when the brush is being moved through the roots of the person's hair.

Referring to FIGS. 1–4, in operation the brush 10 is dipped into a container of hair treatment solution, such as color dye. The center array 28 of bristles has a density and a material makeup to pick up without dripping a sufficient quantity of solution for the application to one hair partition that exposes roots to be treated. The brush is then moved in a direction to properly distribute the solution and to ready the hair for the next application. For example, if the first array of bristles 18–20 is the leading array, these first bristles 18 and 20 function to comb the hair so as to aid in proper solution distribution. The trailing bristles 22 and 24 of the third array function to create a second partition that is parallel to the partition to which the solution is initially being applied. The subsequent application of solution is then at the second partition. This continues until the entire head of hair has been treated.

While the present invention is shown as including three arrays of bristles, the two most important arrays are the center solution-applying array 28 and the end array that is to be used to repartition the hair for a subsequent application of solution. Thus, a brush having only two arrays may be used. However, the third array is clearly preferred, since it serves the function of combing hair and since the three-array arrangement provides a brush that can be used with equal ease on both sides of the person's head at either right to left or left to right direction.

I claim:

1. A device for applying a hair treatment solution comprising:

a brush body having a substantially flat surface having generally parallel first and second longitudinal regions that are spaced apart by a void area, solution-pickup bristle means for retaining hair treatment solution after being dipped into a volume of said solution, said solution-pickup bristle means having a high density array of first bristles extending outwardly from said first longitudinal region of said brush body to form a generally planar surface at outer ends of said first bristles, said first bristles being closely spaced at said outer ends to form a continuous grouping of contacting outer ends for retaining hair treatment solution, and non-absorbent brush means for repartitioning hair, said brush means having a low density array of second bristles extending along said second longitudinal region of said brush body, said first bristles and said second bristles being spaced apart and being generally coterminous at outer ends, said first and second bristles being spaced apart at inner ends by said void area, said generally parallel first and second longitudinal regions of said brush body being disposed relative to each other such that said high density array of first bristles and said low density array of second bristles simultaneously contact hair to be treated, with said void area being sufficiently large such that said solution-pickup bristle means and said brush means are spaced apart by a distance wherein said first and second bristles may be positioned to act upon different hair strands.

2. The device of claim 1 further comprising an array of third bristles generally parallel to said high and low density arrays, said arrays of third bristles having a density less than the density of said first bristles, said high density array being sandwiched by said second and third bristles.

3. The device of claim 2 wherein said brush body has opposed exterior surfaces, said first, second and third bristles all being on a single surface of said exposed exterior surfaces.

4. The device of claim 1 wherein said first bristles are nylon members.

5. The device of claim 4 wherein said second bristles are plastic members having a rigidity sufficient to partition hair.

6. The device of claim 1 wherein said second bristles are in two rows and are arranged in a zig-zag pattern.

7. The device of claim 6 wherein said second bristle is spaced apart from adjacent second bristles by a distance within the range of 0.125 inch to 0.375 inch.

8. The device of claim 1 wherein said first and second longitudinal regions of said brush body each have a length exceeding 2.5 inches.

9. The device of claim 1 wherein said brush body has a handle extending generally perpendicular to the direction of said first and second bristles.

10. A device for applying a hair treatment solution comprising:

a body having a head and having a handle extending from said head, said head having opposed first and second major sides, a first end array of bristles extending from said first major side of said head in a direction perpendicular to said handle, said first end array having a first bristle density, a longitudinal center array of bristles extending from said first major side in a direction perpendicular to said handle, said center array having a second bristle density greater than said first bristle density, bristles of said center array having tightly packed outer ends that are coterminous and that are generally contiguous to provide a planar surface for retaining solution within said center array, and a second end array of bristles extending from said first major side in a direction perpendicular to said handle, said second end array being on a side of said center array opposite to said first end array, said second end array having a third bristle density less than said second bristle density, bristles of said first and second end arrays being generally equal in length to bristles of said center array, said center array spaced apart from said first and second end arrays by void areas, said void areas being sufficiently large that said center array can be positioned to apply solution to a first strand of hair while said fist and second end arrays are positioned to displace strands of hair different from said first strand.

11. The device of claim 10 wherein said first and third bristle densities are substantially equal.

12. The device of claim 10 wherein said first and second end arrays have non-absorbent bristles and said center array has nylon bristles.

13. The device of claim 10 wherein said bristles of said center array are sufficiently tightly packed to trap liquid therebetween.

14. The device of claim 10 wherein said first major side is curved.

15. The device of claim 10 wherein said bristles of said first end array are arranged in two rows in a zig-zag pattern.

16. A method of applying hair treatment solution comprising:

(a) arranging a person's hair to form a partition, thereby exposing roots of a first strand of hair, (b) providing a brush having a high density array of first bristles and an adjacent low density array of second bristles, said high and low density arrays being generally parallel, (c) applying hair treatment solution to said high density array, (d) contacting said high density array to said partition, thereby transferring said hair treatment solution to said roots of said first strand of hair, (e) displacing said high and low density arrays relative to said partition such that said low density array repartitions said hair, said displacing being in a direction such that said low density array trails said high density array, thereby forming a second partition to expose roots of a second strand of hair, and (f) repeatedly following steps (c)-(e) until treatment of roots of said person's hair has been completed.

17. The method of claim 16 wherein said step of providing a brush includes providing a second low density array of third bristles such that said first bristles are sandwiched between said second and third bristles, said step of displacing including combing said hair with said second low density array in a direction away from said partition, said combing with said second low density array including spreading said hair treatment solution.

18. The method of claim 16 wherein applying hair treatment solution to said high density array includes dipping said high density array into a volume of said hair treatment solution.

19. The method of claim 16 wherein providing said brush is a step of providing a brush for which said low density array is spaced apart from said high density array and for which the lengths of said first bristles and second bristles are generally equal.

* * * * *